US005515673A

United States Patent [19]

Leclerco et al.

[11] Patent Number: 5,515,673

[45] Date of Patent: May 14, 1996

[54] DEVICE FOR CONTROLLING THE OPENING AND CLOSING OF DISCHARGE VALVES OF A TURBOJET ENGINE

[75] Inventors: Guy E. O. Leclerco, Melun; Christian A. F. Parisel, Combs La Ville, both of France

[73] Assignee: Societe Nationale d'Etude et de Construction de Moteurs d'Aviation "S.N.E.C.M.A", Paris, France

[21] Appl. No.: 446,334

[22] Filed: May 22, 1995

Related U.S. Application Data

[63] Continuation of Ser. No. 84,959, Jul. 2, 1993, abandoned, which is a continuation-in-part of Ser. No. 947,804, Sep. 21, 1992, abandoned.

[30] Foreign Application Priority Data

Oct. 23, 1991 [FR] France ..... 91 13074

[51] Int. Cl.[6] ..... F02C 9/18

[52] U.S. Cl. ..... 60/226.3; 60/39.092; 60/39.29

[58] Field of Search ..... 60/39.07, 39.092, 60/39.093, 39.29, 226.3

[56] References Cited

U.S. PATENT DOCUMENTS 4,463,552 8/1984 Monhardt et al. .
4,702,070 10/1987 Cureton et al. .
4,815,285 3/1989 Martin .
5,044,153 9/1991 Mouton .
5,123,240 6/1992 Frost et al. .

FOREIGN PATENT DOCUMENTS 0137614 4/1985 European Pat. Off. .
0374004 6/1990 European Pat. Off. .
2266804 10/1975 France .

*Primary Examiner*—Louis J. Casaregola
*Attorney, Agent, or Firm*—Oblon, Spivak, McClelland, Maier & Neustadt

[57] ABSTRACT

A control device makes it possible to rapidly shift the bleed valves of an aircraft turbojet engine to a large opening position when the engine is under low power operation in order to prevent flame-out. The device allows for instantaneously interrupting the action of a control return cable when the valves are open from a certain given value. The device includes a drive support integral with a crank handle, in order to bring about the translation of the return cable, when the latter is not blocked by a translation stop member. The control device is used for opening of bleed valves of turbojet engines having two concentric annular jets.

5 Claims, 5 Drawing Sheets

DEVICE FOR CONTROLLING THE OPENING AND CLOSING OF DISCHARGE VALVES OF A TURBOJET ENGINE

This application is a continuation of application Ser. No. 08/084,959 filed on Jul. 2, 1993, now abandoned, which is a continuation-in-part of Ser. No. 07/947,804 filed on Sep. 21, 1992, now abandoned.

BACKGROUND OF THE INVENTION

1. Field of the Invention

The present invention relates to turbo machines and more particularly doubleflow aircraft turbojet engines (i.e. turbo-engines operating with two concentric annular jets) equipped with bleed (i.e. discharge) valves.

2. Discussion of the Background

With reference to FIG. 1, such turbojet engines conventionally have upstream in the primary flow, i.e. in the internal channel 2, a low pressure axial compressor 3 supplying compressed air to a combustion chamber 8 in which the air is mixed with pressurized fuel. This mixture is burned in order to provide energy downstream of the chamber 8 to an axial turbine, which drives the high pressure compressor 4 and wherein the exiting gases supply the thrust necessary for propulsion of the aircraft. Such turbojet engines have a completely axial configuration. As a result of their frontal intake, they not only absorb the air necessary for their operation but, as a function of the climatological conditions, also sand and water, which are prejudicial to the satisfactory operation of the turbojet engine.

This is in particular the case when the aircraft is confronted with a thunderstorm or passes through a dense, large volume cloud, such as a cumulus or cumulonimbus cloud. Large amounts of water in the form of rain or hail then enter the compressor. If the engine is under full power, the water is immediately evaporated. If it penetrates to the combustion chamber, it is in the form of sufficiently hot vapor and is atomized. It does not lead to the flame-out of the combustion chamber, which is then supplied with a large fuel flow. However, this is not the case when the aircraft is descending, e.g. during an approach phase prior to landing. In this case the turbojet engine is under slow-down conditions, which leads to a low compression ratio and fuel flow. If a significant flow of water or ice fragments then reaches the combustion chamber, this can lead to the extinguishing of the burners. Wet igniter plugs are unable to function when engine flame-out has occurred. If the pilot is unable to leave the critical rain area, the engine or engines can then be completely stopped, with the ensuing risks. This is the common flame-out mode of all the engines.

In order to avoid such problems, which can prove catastrophic, it is known to eliminate the water which has entered the combustion chamber in order to prevent the extinguishing of the burners. For this purpose use is made of bleed valves 1, which open the internal channel 2 onto the external channel 6, said valves being placed between the upstream compressor 3 and the downstream compressor 4. As is shown by the arrow 5, part of the flow returned into the upstream compressor 3 is deflected towards the external channel 6, so that the water or ice liable to seriously prejudice the operation of the turbojet engine is deflected.

These bleed valves 1 are originally provided for preventing the "pumping" phenomenon of the low pressure compressor 3, when it is necessary to pass to it a flow rate exceeding that which could be accepted by the downstream high pressure compressor 4.

With reference to FIG. 2, normal operation of the discharge valves follows the curve shown in solid line form therein. On the abscissa is plotted the operating conditions of the engine and on the ordinate the opening of the valves. As is apparent from the thickline curve, on starting the engine the valves are in the quasi-open position. The valve closure law follows the curve, which decreases in a relatively regular manner and then levels out in front of point C. The curve touches the valve closing line at point D, which corresponds to full power operation.

This operation is realized for the bleed valves by control means and preprogrammed hydromechanical regulating means in order to control the opening and closing of the valves in accordance with said curve.

SUMMARY OF THE INVENTION

The aim of the invention is to modify the operating law of the opening and closing of the valves without changing equipment already existing on the turbojet engines, particularly with respect to the control of these bleed valves. This modification will permit an extended and more logical opening of the bleed valves when the engine has not reached a sufficiently predetermined operating mode. This theoretical modification is shown in FIG. 2 by the mixed line curve from point A to point D and passing through points B and C during an increasing power operation. The fundamental object of the patent is to ensure that, in the case of power reduction under high moisture conditions, the bleed valves pass very rapidly from point C to point B in order to prevent any risk of any engine flame-out.

For this purpose, the main object of the invention is a to provide device for controlling the opening and closing of bleed valves in a double flow turbojet engine, by motor means, control means and a regulating system for actuating the valves in accordance with a given operational curve, and having a lever system connected on the one hand to a valve and on the other hand to a return cable, itself connected to the control means regulating system.

According to the invention, means are provided for eliminating the action of the return cable, when the valves have an opening exceeding a given value, so that the control means do not operate the valves according to said curve when they are open to the given value.

In a main embodiment of the invention, the return cable is integral with a lever for controlling the return cable and on which temporarily rests a drive support or member, whose displacement with respect to the lever is proportional to the valve opening and closing movements.

In this case, the lever system comprises beforehand a rod fixed on the one hand to the valve and on the other fixed to the end of a crank handle mounted in a rotary manner about a rotation shaft or axis, said crank handle being integral in rotation with the drive support, which pivots about the axis along a circular arc and drive the return cable while bearing on the lever.

Preferably, the lever is mounted so as to rotate freely about the axis and the head is mounted so as to rotate freely in articulation of the end of the return cable.

For completing said device, as the return cable is constantly exposed to a return force, the lever can be equipped with a hook, whose end bears on a cable stop, which is regulatable in translation and whose position determines said given valve opening value, which makes it possible to regulate the opening of the valves under low power.

BRIEF DESCRIPTION OF THE DRAWINGS

Various objects, features and advantages of the present invention will become more apparent from the following detailed description taken with the accompanying drawings in which.

DESCRIPTION OF THE PREFERRED EMBODIMENTS

Figure 2:
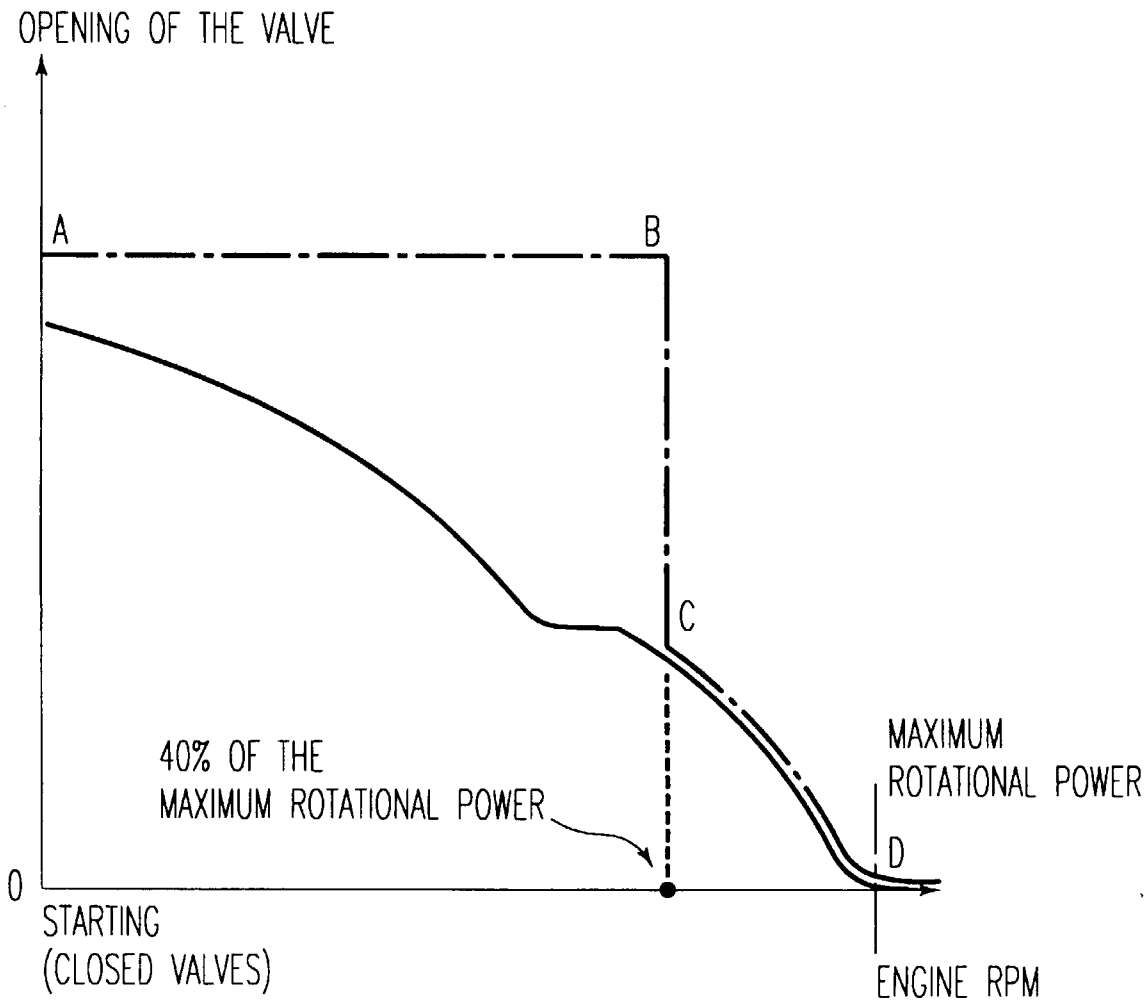
FIG. 2 shows the two operating laws for the bleed valves according to the prior art and according to the invention.

During starting up of the turbojet engine, up to an operating point thereof which can be regulatable, the opening of the valves is at a maximum, which corresponds to the horizontal segment A–B of the curve of FIG. 2. Points B and C have an abscissa corresponding to the operating point of the turbojet engine as from which the opening of the valves can be decided. This regulatable operating point can, for example, be 40% of the maximum rotational power of the low pressure body of the turbojet engine. Obviously other values could be chosen.

The second, vertical segment B–C of the curve consequently symbolizes the start of the closure of the valves while the engine rotates at a constant power value. Point C symbolizes an opening of the valves, which is the same as for the traditional closing law and for the same given operating point. As from said point C, the valves can reassume the traditional closing cycle. This latter part is symbolized by segment C–D of the mixed curve common to the curve representing the traditional closing law according to the prior art.

Thus, when the aircraft passes through dense clouds or hail, a supplementary water quantity will be passed towards the secondary flow, if the operating conditions of the turbojet engine are below those symbolized by points B and C. This supplementary water quantity corresponds to the surface area between the prior art curve and the three points A, B and C. Therefore the combustion chamber extinction margin is increased.

Figure 1:
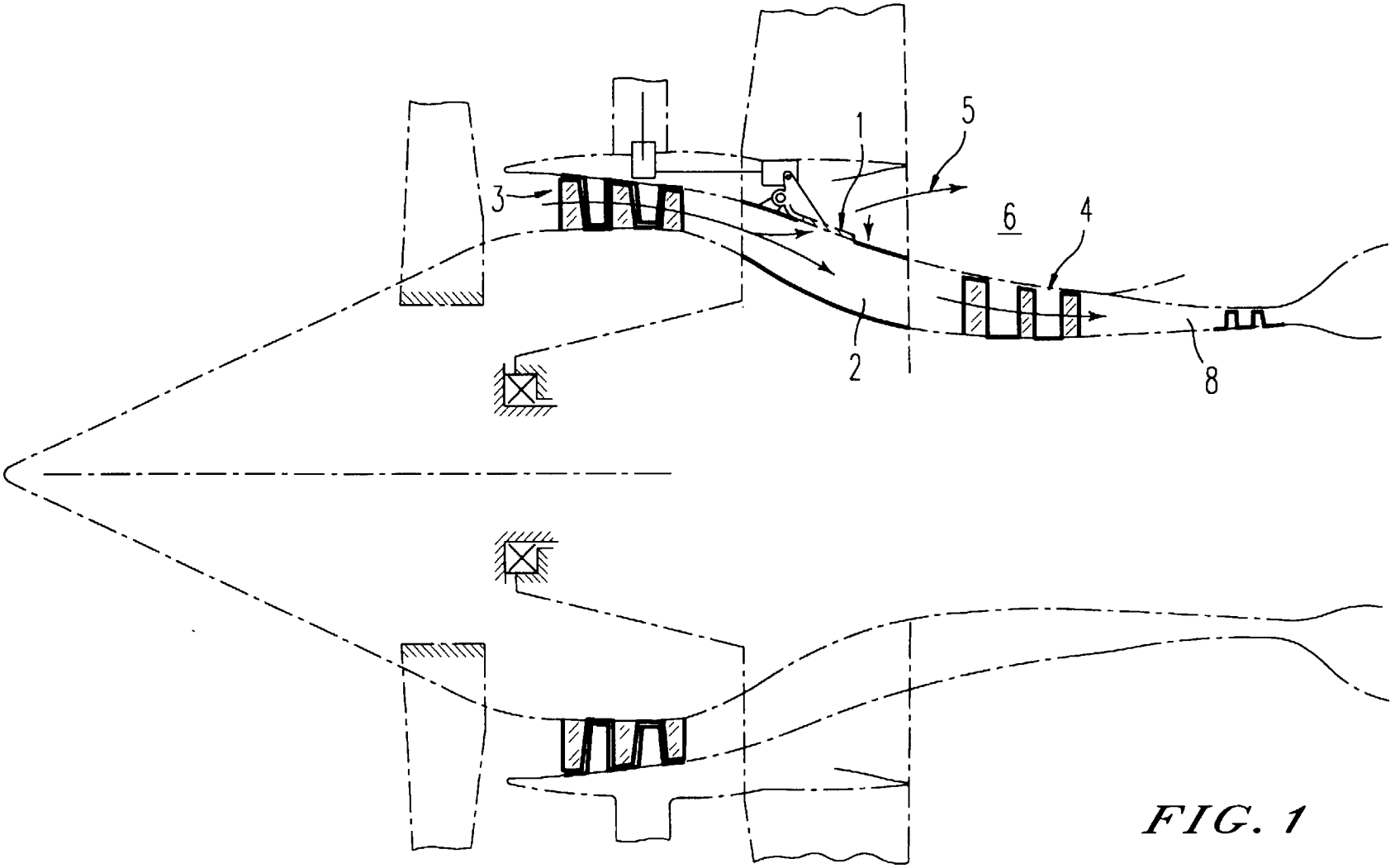
FIG. 1 shows the bleed valves in a known doubleflow turbojet engine.
Figure 3:
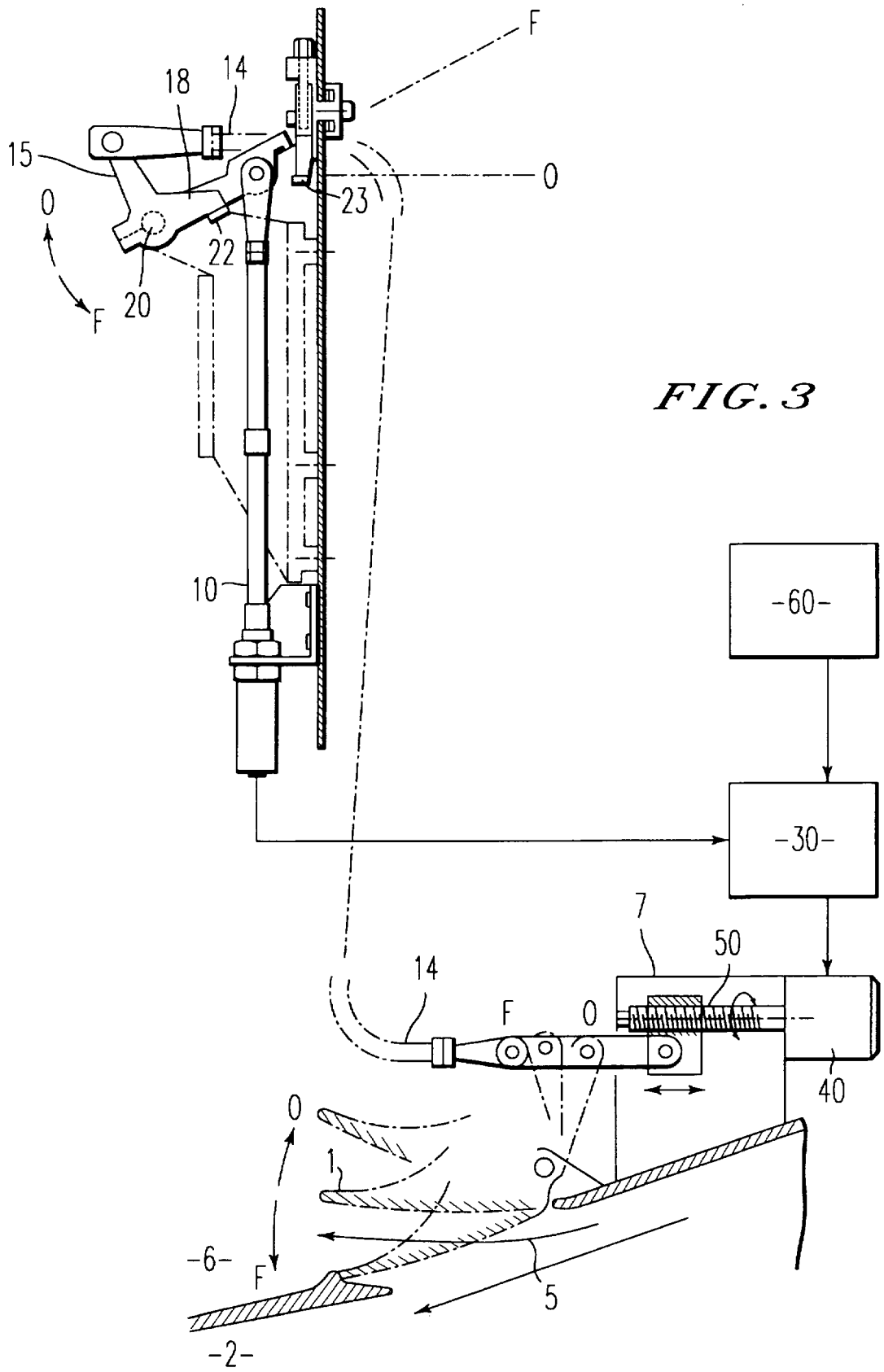
FIG. 3 shows the device according to the present invention relating to the opening of a bleed valve.

At the bottom of FIG. 3 can be seen a discharge valve 1, such as has been described relative to FIG. 1, while at the top can be seen the control device according to the present invention.

The bleed valve 1 is shown in an open position, so as to allow the passage of a certain part 5 of the flow from the primary channel 2 to the secondary channel 3. The control and regulating means 30 are connected to the control device by a thick, mixed line symbolizing a rod 14, whose two ends are shown. These control regulating means 30 control a device 7 for actuating the bleed valve 1 via motor means 40. The movements of the valve actuating device 7 simultaneously bring about the horizontal displacement of the rod 14. The latter drives in a known manner a crank handle 15, 18 in a rotary manner about an axis or shaft 20. The second part 18 of the crank handle is connected by an articulation member to the end of a return cable 10. The return cable 10 is connected to the control and regulating means of the control system for the bleed valves 1. The function of the return cable 10 is to signal to the control and regulating means 10 the real opening position of the bleed valve 1. Thus, the return cable 10 is controlled by part of a bleed valve 1 via the rod 14. It therefore constitutes a component of the control loop for controlling the bleed valves 1.

The control device according to the invention is mainly constituted by a lever system incorporating members acting in connection with the transmission of said return movement between the rod 14 and the return cable 10. The principle consists of interrupting the translatory movement of the return cable 10 when the valves 1 are open, i.e. in the area corresponding to the portion A to C of the curve of FIG. 2. Thus, it is a question of immobilizing the return cable 10 and the main elements involved are a drive member or support 22 integral with the crank handle 15, 18, a lever 19 integral with the head of the return cable 10 and a cable stop 17 for immobilizing the return cable 10 during the full opening of the bleed valves 1. Operation of the device will now be described in greater detail relative to FIG. 4. However, this can be summarized by pointing out that the return cable 10 is immobilized in translation by the cable stop 17 no matter what the position of the crank handle 15, 18 at the start of opening, when the drive support 22 is not in contact with the lever 19 integral with the return cable 10. Rotation of the crank handle 15, 18 then brings about the translation of the cable 10.

Figure 4:
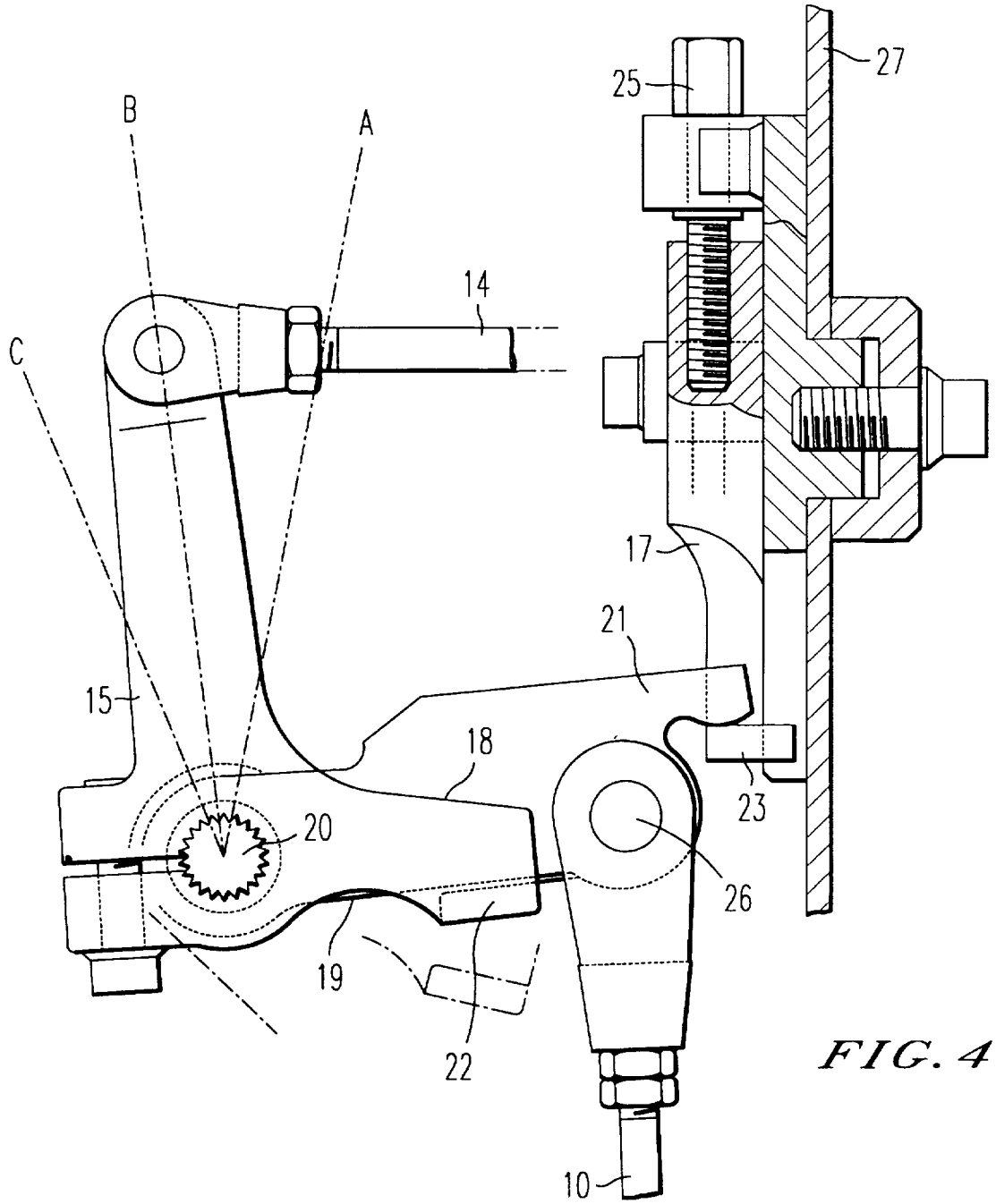
FIG. 4 shows the device according to the present invention in detail.

With reference to FIG. 4, the complete opening position of the valves corresponding to points A and B of the curve of FIG. 2 is designated by the same letters A and B. The rod 14 is returned to the right. The crank handle constituted by a first lever 15 and a second control lever 18, which are integral with one another about a rotational axis 20, is oriented downwards, the end of the lever 15 being pulled by the rod 14. In this position, the second lever 18 is not in rotary contact with the lever 19 integral with the return cable 10. In the embodiment described here, the lever 19 rotates freely about the horizontal shaft 20 and the articulation head 26 of the return cable 10. Thus, the latter is maintained at an adequate height by a regulatable cable stop 23, which is fixed with respect to the entire device and which keeps the lever 19 at a given height by means of a hook 21 integral with the lever 19. The end of the hook 21 bears on the stop 23. The return cable 10 is thus maintained at a desired height. Thus, when the crank handle 15, 18 has not assumed an angular orientation to the left of an adequate magnitude for rotating the lever 19 by its drive support 22, the return cable is immobilized in the position defined by the cable stop 23.

Figure 5C:
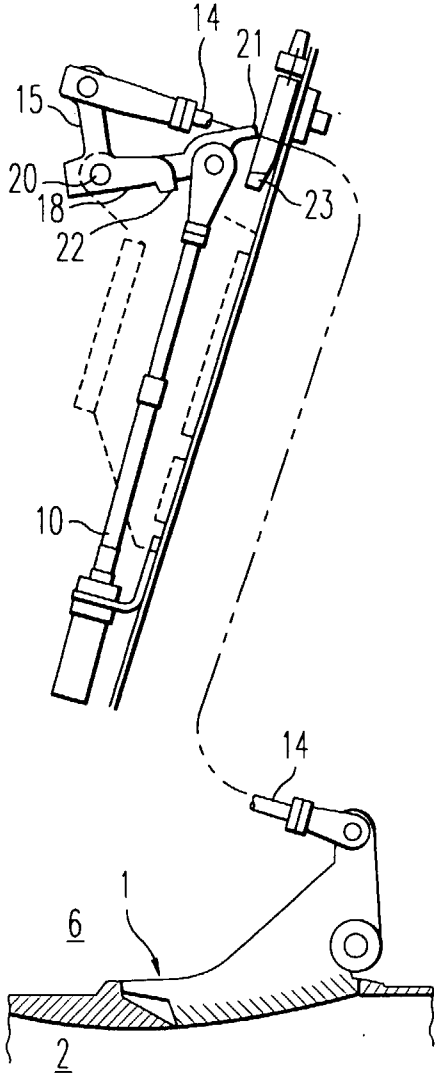
FIGS. 5A, 5B and 5C show three operating positions of the device according to the present invention.
Figure 5B:
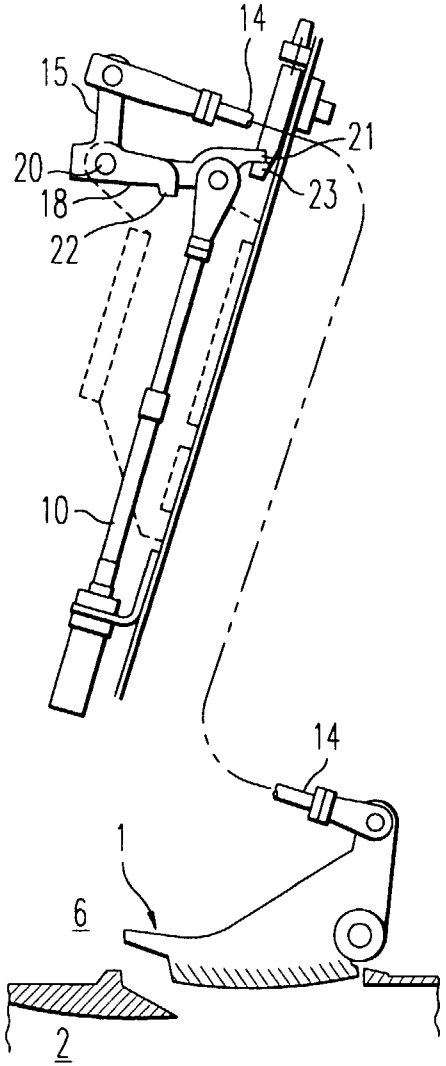
Figure 5A:
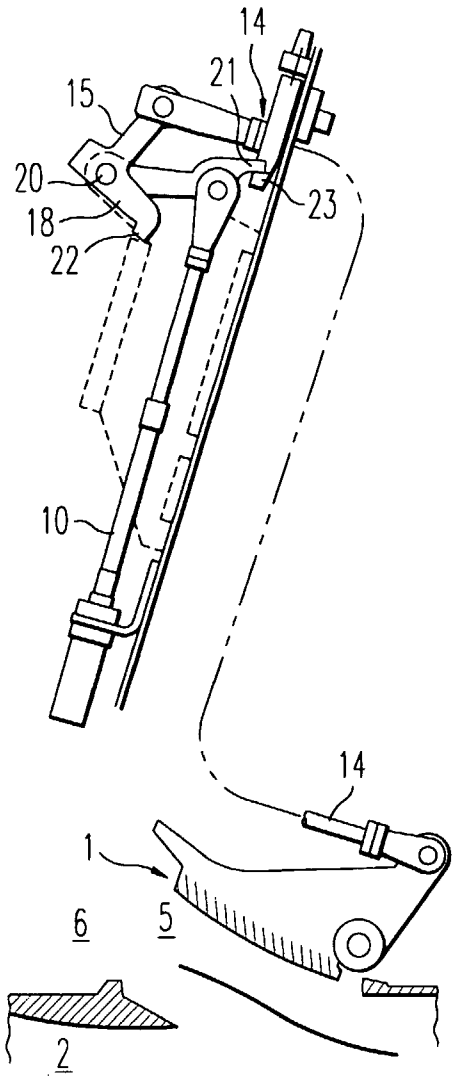

As shown in FIGS. 5A and 5B, when the engines r.p.m. reaches 40% of maximum power, the beginning of closure of the bleed valves takes place and this corresponds to segment B–C of FIG. 2. In order to carry out this closure, a main regulator 60 of the aircraft supplies a control signal to the control and regulating means 30. The main regulator 60 and the controlling regulating means 30 are of a known type, as appears in the CFM M56 Turbofan Engine Illustrated Parts Catalog of CFM International, and form part of a variable bleed valve system as shown in this catalog. Thus, the control and regulating means 30 starts the motor means 40, independently of the return from the return cable 110. Therefore, the return cable 10 is actuated and the bleed valves are progressively closed up to an opening value corresponding to point C in FIG. 2. Simultaneous with this closure, the rod 14 pivots the crank handle 15. The point in time when the drive member of support 22 comes back into contact with the lever 19 corresponds to point C in FIG. 2. The return cable 10 is then pulled. Thus, as of this time the position is along segment CD of FIG. 2, and the closing curve of the bleeding valves 1 is the same as previously mentioned. FIG. 5A corresponds to the open valve position and FIG. 5B to the said switching point C.

From this instant and with reference to FIGS. 5B and 5C, the closing of the valves 1 makes the rod 14 continue its translation to the left in the manner indicated by the arrow in FIG. 3, and the lever 19 is rotated about the shaft 20. The hook 21 integral therewith is disengaged from the stop 23 and the return cable is driven upwards. This operation corresponds to the final segment C, D of FIG. 2 and the return cable 10 has the same function as in the prior art. FIG. 5C corresponds to the closed valve position or point D in FIG. 2.

Thus, it is possible to modify the existing, prior art control system (i.e. the rod 14, crank handle 15, 18 and return cable 10) by simply adding a certain number of modifications. This consists of adding the drive support 22 of the lever 19, as well as its hook 21 and the cable stop 23.

It is also advantageous to be able to regulate the point C of FIG. 2 as from which, during a closure of the bleed valves, the return cable 10 reassumes its initial function. This regulation can be obtained by making the position of the cable stop 23 adjustable. To this end, it is fixed to a support 17, which slides along a frame of the turbojet engine 27 and whose position can be regulated by means of an adjusting screw 25.

Obviously, the shape and arrangement of the different components described and which cooperate to ensure that the action of the return cable 10 is interrupted when the valves are in the open position, only constitute possible examples. The inventive concept is the immobilization of the return cable 10 in a given position, when the discharge valves are open. FIG. 4 only relates to an exemplified embodiment appropriate for certain existing turbojet engines using a control loop provided by a rod 14 and a return cable 10.

The main advantage sought and obtained with the control device according to the invention is the improvement of the operating conditions of the engine under humid conditions (passing through severe thunderstorms, hail and snow), while in particular avoiding flame-out of the combustion chamber, which would lead to the stopping of the engine.

What is claimed as new and desired to be secured by Letters Patent of the United States is:

1. Device for controlling the opening and closing of a bleed valve in a doubleflow turbojet engine using a motor mechanism and a control and regulating mechanism actuating the bleed valve according to a given curve, comprising:

a lever system connected to said bleed valve, a return cable connected to said lever system, said return cable indicating an opening position of the bleed valve, said cable being connected to the control and regulating mechanism and providing a bleed valve position feedback signal to the control and regulating mechanism, and a mechanism immobilizing the return cable so as to provide a false feedback signal to the control and regulating mechanism as to the position of the bleed valve when the valve is open beyond a given value, so that the control and regulating mechanism does not operate the valve in accordance with said given curve when the valve is open to said value.

2. Device according to claim 1, which comprises in the lever system a lever integral with the return cable for controlling the return cable and a drive support which at least temporarily bears on said lever wherein displacement of said drive support with respect to the lever is proportional to opening and closing movements of the valves, and a cable stop for preventing the return cable from permanently bearing on the drive support.

3. Device according to claim 2, wherein the lever system includes a rod fixed to the valve and a crank handle connected to said rod, said crank handle being mounted so as to rotate about a shaft, wherein the drive support is integral in rotation with the crank handle which pivots about the shaft about a circular arc and said crank handle drives the return cable.

4. Device according to claim 3 wherein an articulation member is located at the end of the return cable and the lever is freely rotatable about said shaft and has a head which rotates freely about said articulation member.

5. Device according to claim 2, which comprises a translation-regulatable cable stop member wherein said return cable is continuously subjected to a return force, and wherein the lever has a hook having an end which bears on said translation-regulatable cable stop member.

* * * * *